United States Patent [19]

Holt

[11] Patent Number: 4,738,201

[45] Date of Patent: Apr. 19, 1988

[54] CONTROL DEVICES

[76] Inventor: Alan W. Holt, British Aerospace PLC, Six Hills Way, Stevenage, United Kingdom, SG1 2AS

[21] Appl. No.: 925,255

[22] Filed: Oct. 31, 1986

[30] Foreign Application Priority Data

Oct. 31, 1985 [GB] United Kingdom ..... 8526848

[51] Int. Cl.[4] ..... F42C 15/04; F42C 15/24; F42C 15/26

[52] U.S. Cl. ..... 102/231; 102/221; 102/262; 102/264

[58] Field of Search ..... 102/231–233, 102/235, 240–243, 245, 247, 251, 262, 264, 221, 378, 379, 380

[56] References Cited

U.S. PATENT DOCUMENTS

| | | | |
|---|---|---|---|
| 1,357,703 | 11/1920 | Guerritore | 102/221 |
| 2,398,734 | 4/1946 | Busacker | 102/262 X |
| 2,928,347 | 3/1960 | McLean | 102/262 X |
| 3,001,043 | 9/1961 | Evans | 102/262 X |
| 3,167,018 | 1/1965 | Brunner | 102/262 |
| 3,479,476 | 11/1969 | Swaim | 102/262 X |
| 4,372,212 | 2/1983 | Hoelzen et al. | 102/264 |

*Primary Examiner*—David H. Brown

*Attorney, Agent, or Firm*—Cushman, Darby & Cushman

[57] ABSTRACT

Apparatus for e.g. igniting a boost motor of a spinning projectile comprises an inertia wheel (5) which remains stationary within the spinning projectile and a linearly movable member (10) initially decoupled from the inertia wheel but become engaged therewith when a predetermined linear acceleration state of the projectile is attained and which then initiates winding up of a flexible tape coupled to a switch mechanism. When the tape has been fully wound up, i.e. when the missile has spun through a preset number of turns, the switch mechanism is pulled to operate it via the tape. Thus, the switch mechanism is only operated when the predetermined linear acceleration condition and the preset number of rotations (which equates to a preset flight distance) have been attained.

8 Claims, 4 Drawing Sheets

CONTROL DEVICES

The invention relates to control devices of the type in which a set of predetermined conditions have to be attained before an output response is provided.

According to one aspect of the invention, there is provided a control device for sensing the attainment of predetermined values of linear acceleration and angular velocity applied to a structure and for providing an output response consequent on said attainment, the device including:

support means fixed with respect to said structure;

inertia means mounted for rotation about a fixed axis with respect to said support means;

mass means biased towards an engaged position in which it engages said inertia means; and latch means mounted for movement with respect to said support means for a latching position to a free position on application of sufficient angular velocity to said support means;

said latch means and said mass means being adapted, so that when the device is initially at rest, said latch means and said mass means are in a state of initial engagement wherein said mass means is maintained at a safe position spaced from said inertia means, and said latch means is prevented from moving to said free position, and that when sufficient linear acceleration and angular rotation are applied, said mass means is moved against its bias to release the latch means for movement to its free position thereby enabling engagement of said mass and said inertia means so as to provide said output response.

According to a second aspect of the invention, there is provided a control device for sensing the attainment of predetermined values of linear acceleration and angular velocity applied to a structure and for providing an output response consequent on said attainment, the device including:

support means fixed with respect to said structure;

inertia means mounted for rotation about a fixed axis with respect to said support means;

spring means;

mass means for moving from a first to a second position against the action of said spring means in response to linear acceleration applied to said structure; and locking means attached to said support means and operable for retaining said mass means in a fixed position spaced from said inertia means until said linear acceleration is attained and then for moving outwards in response to said angular velocity;

said mass means being further operable for moving from said second position to a third position through said first position under the action of said spring means in response to cessation of said linear acceleration to engage said inertia means thereby providing said output response.

Advantageously, said control device further includes a member and an elongate flexible element, respective ends of said element being coupled to said member and said mass means, said mass being mounted for relative rotation with respect to said member, so that during said relative rotation said element becomes wound onto said mass means through a plurality of turns and when so wound pulls said member to initiate said response.

According to a third aspect of the invention there is provided a projectile comprising:

a body having a spin axis about which the body rotates during flight of the projectile;

switch means mounted in the body;

a flexible elongate member coupled to the switch means for being tensioned to operate the switch means;

an inertia member mounted within said body for rotation about said spin axis with respect to the missile body; and coupling means for coupling said flexible elongate member to said inertia member to wind up said flexible elongate member through a plurality of turns and then to tension the flexible elongate member and operate the switch means.

For a better understanding of the invention, reference will now be made, by way of example, to the accompanying drawings in which.

Figure 1:
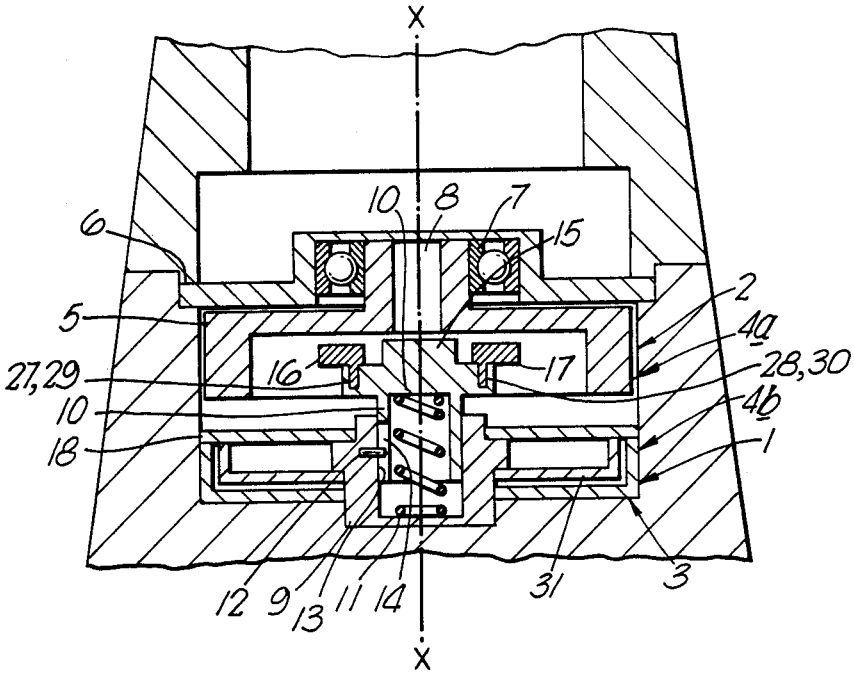
FIG. 1 is a sectional side elevation of part of a projectile body incorporating a control device according to the invention before launch.
Figure 2:
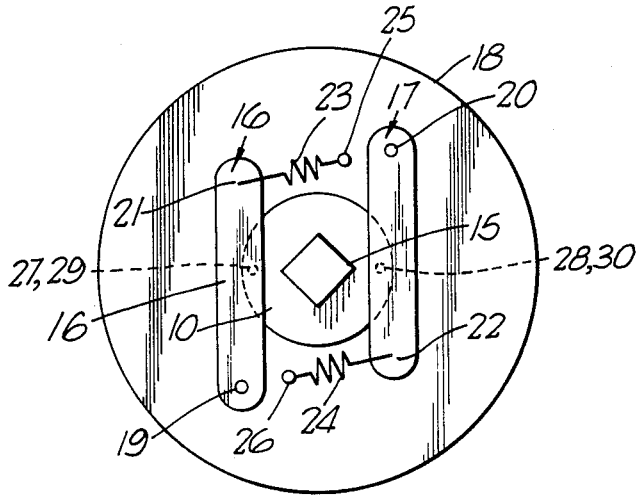
FIG. 2 is a plan view of FIG. 1 with the inertia wheel and bearing removed.
Figure 3:
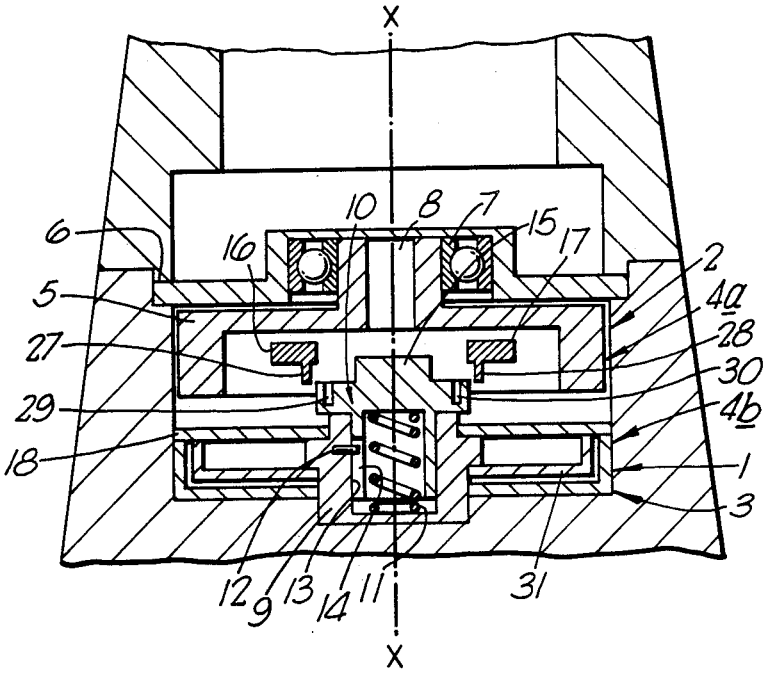
Figure 4:
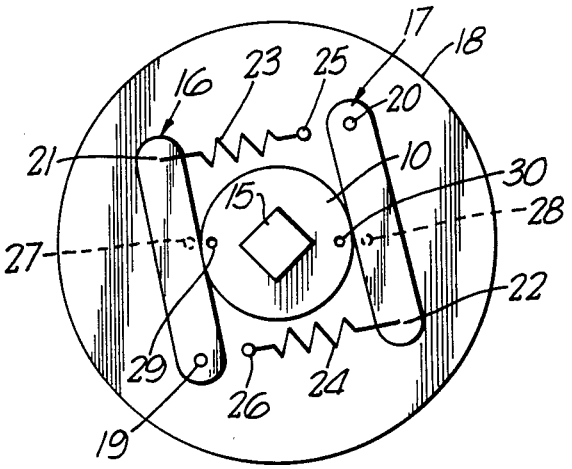
Figure 5:
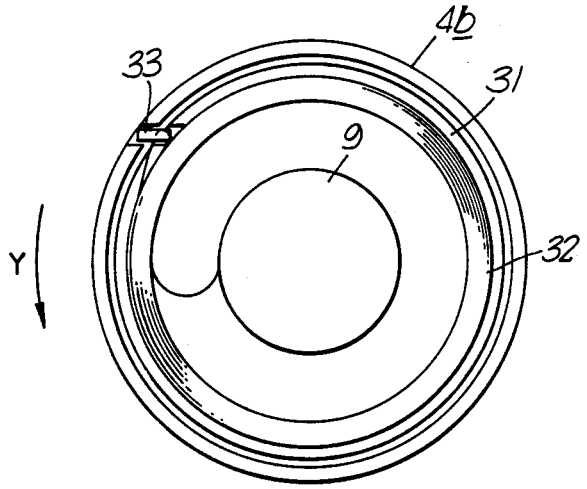
Figure 6:
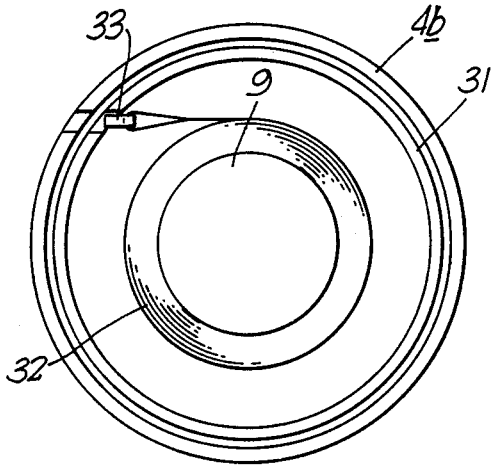

FIG. 3 corresponds to FIG. 1 after launch, during the linear acceleration/angular velocity phase;

FIG. 4 corresponds to FIG. 2 after launch, during the linear acceleration/angular velocity phase;

FIG. 5 is a plan view of the distance measuring portion of the device before launch;

FIG. 6 corresponds to FIG. 5, with the latch disengaged from the casing;

FIG. 7 is a view illustrating the relative position of the contacts and pins before launch; and FIG. 8 corresponds to FIG. 7 with the switches made by the engagement of the contacts and pins.

The control device to be described is intended for use on board a spinning projectile which has both an expulsion motor and a boost motor, the expulsion motor being used to launch the projectile and the boost motor to provide subsequent control by increasing its range, for example. In such missiles, it is desirable that ignition of the boost motor only occurs when certain predetermined conditions have been satisfied. For example, the boost motor is ignited only when the projectile has:

(a) been subjected to sufficient linear acceleration;

(b) attained sufficient angular velocity i.e. spin;

(c) been subjected to a cessation of linear acceleration or deceleration; and (d) travelled a predetermined distance from its launch point.

A device which provides an output response only when the above mentioned conditions have been satisfied will now be described.

Referring initially to FIG. 1, a control device 1 is mounted on the spin axis X—X of a spinning projectile, only a part of the projectile body being shown. The device 1 comprises two inter-related parts: a linear acceleration and angular velocity sensitive part 2; and a distance measuring part 3, each part being housed in respective housing portions 4*a* and 4*b* as shown. The linear acceleration and angular velocity sensitive part 2 comprises a cup-shaped inertia wheel 5 which is mounted for relative rotation with respect to a portion 6 of the projectile body by means of a bearing 7. By relative rotation is meant that the wheel 5 remains stationary inside the spinning projectile and provides a reference with respect to space. The inertia wheel 5 has a central square hole 8 formed in it which forms part of a 'clutch' mechanism which will be described later in more detail. A hollow hub 9 is mounted in the housing 4*b* and extends into the part 2. A mass 10 is positioned in the hub 9 on a helical compression spring 11, and is connected to it by means of a pin 12 protruding from the internal surface 13 of the hub 9 and which pin engages with a slot 14 formed in the mass 10. This connection allows limited relative movement between the mass 10 and the hub 9 parallel to the spin axis X—X. A portion 15 of the mass 10 is adapted for engagement with the hole 8 in the wheel 5, the mass 10 being held in the hub 9 against the force of the spring 11 by means of two elongate arm members 16,17 (see also FIG. 2). The arm members 16,17 are each pivotably attached to a plate 18 within the device 1 at one end by means of pins 19,20. The other end 21,22 of each arm member is fixed to one end of a coiled spring 23,24—the other end of which is also fixed to the plate 18 by pins 25,26. Each arm member 16,17 has a spigot portion 27,28 adapted for engagement with holes 29,30 formed in the mass 10. In the pre-launch state, the arm members 16,17 hold the mass 10 spaced from the wheel 5.

During launch, the projectile experiences high linear acceleration and this has the effect of moving the mass 10 rearwards against the force of the spring 11 as shown in FIG. 3. This releases the arm members 16,17 which move outwards in response to the experienced angular velocity stretching the springs 23,24 as shown in FIG. 4, the angular velocity being due to the spin imparted to the projectile during launch. The mass 10 and the hub 9 spin with the projectile body relative to the wheel 5 until the high acceleration phase is over. At this point, the mass 10 is free to move forwards and is urged to do so by the force of the spring 11. The mass 10 travels forwards along axis X—X until it engages with the square hole 8 in the wheel 5, i.e. the portion 15 of the mass 10 engages with the hole 8 within quarter of a revolution, this being the aforementioned 'clutch' mechanism. Once the mass 10 is engaged with the wheel 5, the mass no longer spins with the projectile body, but spins relative to it at a lower angular velocity—this being due to the high inertia of the wheel 5. As the mass 10 is connected to the hub 9 by means of the pin 12 engaging in the slot 14, the two then rotate together, with the wheel 5, relative to the projectile body. This then initiates the operation of the distance measuring part 3.

The lower housing portion 4*b* shown in more detail in FIGS. 5 and 6, contains the distance measuring part 3 which comprises a rotatable drum 31 mounted within the housing 4*b*; a coil of steel tape 32 which is initially wrapped around the inside wall of the drum 31 as shown, and the hub 9. Initially the housing 4*b* and the drum 31 are latched together by a latch 33 which is attached to the drum-side end of the tape 32, the other end of the tape being attached to the hub 9. Therefore, the drum 31 and its contents spin with the projectile. When the hub 9 begins to spin with the wheel 5 relative to the housing 4*b* and the projectile body due to the engagement of the portion 15 of the mass 10 with the hole 8 in the wheel 5, the housing 4*b* and the drum 31 continue spinning with the projectile body causing the tape 32 to be wound onto the hub 9 from the wall of the drum 31. When all the tape 32 has been wound onto the hub 9, the latch 33 is pulled out of engagement with the housing 4*b* and allows relative rotation of the housing 4*b* and the drum 31.

FIGS. 7 and 8 illustrate how the electrical connections 40 are made to the ignition device 42 of the boost motor 44 (elements 40, 42 and 44 being shown diagrammatically in FIG. 7) as the relative rotation between the housing 4*b* and drum 31 occurs. Five metal contacts 34, only one of which is shown for clarity, are mounted in the drum 31. These contacts 34 make electrical connections with five pairs of metal pins 35 mounted in the housing 4*b*. In the 'locked' position, FIG. 7, i.e. with the housing 4*b* and the drum 31 latched together, each contact 34 only connects with one of each pair of pins 35. As the housing 4*b* rotates relative to the drum 31, in the direction of arrow 'Y', the contacts 34 move across to connect two adjacent pins 35 i.e. both pins in a pair, to make the required switches. A stop peg 36 in the housing 4*b* engages with a slot 37 in the drum 31, and during the relative rotation of the drum and housing moves from one to other end of the slot. When the peg 36 has engaged the other end of the slot, as shown in FIG. 8, the drum 31, hub 9 and wheel are forced to start rotating with the housing 4*b* i.e. with the projectile. One side of slot 37 is formed so as to define a spring finger 38 extending from the other to the one end of the slot. The end of the spring finger forms a detent which, initially, gives additional retainment of drum and housing in the 'safe' position of FIG. 7, i.e. which ensures that the drum 31 and housing 4*b* do not move to the FIG. 8 position prematurely in the event of failure of the latch 33. When the drum 31 is pulled around to the FIG. 8 position by the tape, the spring finger is forced aside to permit this but nevertheless remains in spring engagement with the peg 36 to help maintain the drum and housing in the FIG. 8 'switch made' position.

Connections 40 between the pins 35 and the projectile electronics may be made via film wiring soldered to the ends of the pins (not shown).

I claim:

1. An acceleration, rotation rate, and rotation amount sensitive control device comprising:

support means;

output means supported by the support means and including a movable part for being moved relative to the support means to produce an output response of the control device;

first and second rotary members each supported by the support means for the support means to rotate relative to the rotary members about a common axis, the first rotary member having substantial inertia for this member to tend to remain still during such rotation of the support means;

latch means supported by the support means between said first and second rotary members for movement, from an inward position, radially outwards from said axis in response to centrifugal force experienced by the latch means during said rotation of the support means;

a coupling member mounted between said first and second rotary members for movement along said axis and operable for engaging said latch means while the latch means is in said inward position for being prevented from moving in one direction along said axis, for responding to substantial acceleration of the control device in said one direction to be prevented from moving in said one direction, and further operable, when said latch means has moved out of said inward position and said substantial acceleration is not present, for moving in said one direction to become engaged between the first and second rotary members and to couple them together thereby initiating relative rotation of the support means and the second rotary member; and movement transmission means coupled between said second rotary member and the movable part of said output means and operable for responding to relative rotation of said support means and said second rotary member through a plurality of turns to then move said movable part of said output means and initiate production of said output response.

2. A control device according to claim 1, wherein said movement transmission means comprises an elongate flexible element connected between the second rotary member and the movable part of said output means and operable, during said relative rotation of the support means and the second rotary member, for becoming wound through a plurality of turns onto the second rotary member and for then pulling said movable part of the output means to initiate production of said output response.

3. A control device according to claim 1, wherein said output means is an electrical switch including first electrical contact means fixed with respect to the support means and second electrical contact means supported by said movable part of the output means and operable for moving into and out of engagement with the first electrical contact means.

4. A control device according to claim 1, including spring means engaged with said coupling member for urging it to move in said one direction.

5. A control device according to claim 1 wherein:

said first rotary member has wall portions defining an axially-extending non-circular hole which is open towards said coupling member; and said coupling member is supported by the second rotary member for sliding movement relative to the second rotary member along said axis and for being prevented from rotating relative to second rotary member;

the said coupling member having an end portion shaped for entering into interlocking engagement with the hole in said first rotary member following movement of the coupling member in said one direction along said axis towards the first rotary member.

6. A control device according to claim 1, wherein said coupling member is further operable, while engaged with said latch means, for preventing the latch means from moving out of said inward position, and for moving in said other direction along the said axis in response to said substantial acceleration of the control device to release the latch means for said radial movement thereof.

7. A projectile comprising:

a body having a spin axis extending fore and aft through the body and about which the body spins during flight of the projectile; and an acceleration, rotation rate, and rotation amount sensitive control device comprising:

support means;

output means supported by the support means and including a movable part for being moved relative to the support means to produce an output response of the control device;

first and second rotary members each supported by the support means for the support means to rotate relative to the rotary members about a common axis, the first rotary member having substantial inertia for this member to tend to remain still during such rotation of the support means;

latch means supported by the support means between said first and second rotary members for movement, from an inward position, radially outwards from said axis in response to centrifugal force experienced by the latch means during said rotation of the support means;

a coupling member mounted between said first and second rotary members for movement along said axis and operable for engaging said latch means while the latch means is in said inward position for being prevented from moving in one direction along said axis, for responding to substantial acceleration of the control device in said one direction to be prevented from moving in said one direction, and further operable, when said latch means has moved out of said inward position and said substantial acceleration is not present, for moving in said one direction to become engaged between the first and second rotary members and to couple them together thereby initiating relative rotation of the support means and the second rotary member; and movement transmission means coupled between said second rotary member and the movable part of said output means and operable for responding to relative rotation of said support means and said second rotary member through a plurality of turns to then move said movable part of said output means and initiate production of said output response, said control device being mounted in said body with said common axis aligned with said spin axis of the body and so that said one direction is the forward direction of flight of the projectile.

8. A projectile according to claim 7 including boost motor means for boosting the flight of the projectile, said output means of the control device being coupled to the boost motor means for initiating firing thereof.

* * * * *